US007713182B2

(12) United States Patent
Bizzell et al.

(10) Patent No.: US 7,713,182 B2
(45) Date of Patent: May 11, 2010

(54) EXERCISE DEVICES

(75) Inventors: Daniel Lee Bizzell, Davidson, NC (US); Andrew Donati, Charlotte, NC (US); Ryan Gorman, Charlotte, NC (US); Chris Hoy, Charlotte, NC (US); Todd Stancombe, Charlotte, NC (US)

(73) Assignee: Edison Nation, LLC, Charlotte, NC (US)

( * ) Notice: Subject to any disclaimer, the term of this patent is extended or adjusted under 35 U.S.C. 154(b) by 0 days.

(21) Appl. No.: 11/936,066

(22) Filed: Nov. 6, 2007

(65) Prior Publication Data

US 2008/0108487 A1 May 8, 2008

Related U.S. Application Data

(60) Provisional application No. 60/864,437, filed on Nov. 6, 2006.

(51) Int. Cl.
*A63B 26/00* (2006.01)

(52) U.S. Cl. ..... 482/142; 482/140; 482/79; 482/141

(58) Field of Classification Search ..... 482/142, 482/140, 41, 91, 907, 141, 79, 34
See application file for complete search history.

(56) References Cited

U.S. PATENT DOCUMENTS 1,230,642 A * 6/1917 Albano ..... 482/142
1,422,555 A * 7/1922 Fuller ..... 34/95.4
1,911,572 A * 5/1933 Hulander et al ..... 482/142
2,714,007 A 7/1955 Jordan
2,820,454 A 1/1958 Wright
2,829,891 A * 4/1958 Ludwig ..... 482/146
2,941,801 A * 6/1960 Pedersen ..... 482/146
2,950,120 A * 8/1960 Stewart ..... 482/51
3,024,021 A 3/1962 Coplin et al.
3,044,773 A * 7/1962 Cox ..... 472/114
3,046,011 A * 7/1962 Songer ..... 472/113
3,130,964 A 4/1964 Johnson (Continued)

OTHER PUBLICATIONS

"International Search Report" and "Written Opinion" Serial No. PCT/US2008/064815, dated Jun. 16, 2008, 9 pages, submitted by Applicant on Oct. 26, 2009.

*Primary Examiner*—Lori Baker
(74) *Attorney, Agent, or Firm*—Tillman Wright, PLLC; Chad D. Tillman; James D. Wright

(57) ABSTRACT

An exercise device comprises a frame, including a pair of arcuate rails having a central curved portion, a first end, and a second end. The pair of rails are disposed in fixed parallel relation with one another with a first end member interconnecting the first ends of the rails and a second end member interconnecting the second ends of the rails. The exercise device further comprises a platform operatively connected to the frame for supporting a person thereon. The device may be oriented in various orientations including: 1) a rocking orientation wherein the curved portions of the pair of rails abut a surface on which the device is placed such that the device may move in a rocking motion relative to the surface and 2) a stationary orientation wherein the first end member and the second end member abut the surface on which the device is placed such that the device is stationary relative to the surface.

14 Claims, 8 Drawing Sheets

U.S. PATENT DOCUMENTS

| | | | | | |
|---|---|---|---|---|---|
| 3,188,087 | A | * | 6/1965 | Larson, Jr. | 273/115 |
| 3,201,120 | A | * | 8/1965 | Moravetz | 482/26 |
| 3,207,510 | A | | 9/1965 | Gibson | |
| 3,279,794 | A | * | 10/1966 | Jenkins | 472/114 |
| 3,356,367 | A | | 12/1967 | Tewksbury | |
| 3,475,020 | A | * | 10/1969 | Schauerte | 482/146 |
| 3,582,066 | A | | 6/1971 | Horace | |
| 3,612,520 | A | | 10/1971 | Chang et al. | |
| 3,664,666 | A | | 5/1972 | Lloyd | |
| D227,584 | S | | 7/1973 | Perez | |
| 3,862,768 | A | | 1/1975 | England | |
| 3,893,667 | A | | 7/1975 | Snyder, Jr. et al. | |
| 3,895,794 | A | * | 7/1975 | England | 482/146 |
| 3,984,100 | A | | 10/1976 | Firster | |
| 4,037,834 | A | | 7/1977 | Oaks | |
| 4,159,826 | A | | 7/1979 | Hancock | |
| 4,183,521 | A | * | 1/1980 | Kroeker | 482/146 |
| 4,191,371 | A | | 3/1980 | Armer, Jr. | |
| 4,199,136 | A | | 4/1980 | Mansfield | |
| D256,141 | S | | 7/1980 | Lubbe | |
| 4,253,661 | A | | 3/1981 | Russell | |
| 4,290,601 | A | | 9/1981 | Mittelstadt | |
| D268,280 | S | | 3/1983 | Rodger | |
| 4,403,773 | A | | 9/1983 | Swann | |
| 4,429,869 | A | | 2/1984 | Eckstein | |
| 4,492,376 | A | | 1/1985 | Schatz et al. | |
| 4,505,477 | A | | 3/1985 | Wilkinson | |
| 4,509,743 | A | | 4/1985 | Lie | |
| 4,516,767 | A | | 5/1985 | Eskijian | |
| D281,343 | S | | 11/1985 | Krive | |
| 4,601,469 | A | | 7/1986 | Sasser, Jr. | |
| 4,603,851 | A | | 8/1986 | Russell | |
| 4,605,224 | A | | 8/1986 | Torii | |
| 4,629,181 | A | | 12/1986 | Krive | |
| 4,645,204 | A | | 2/1987 | Berger | |
| 4,673,180 | A | | 6/1987 | Rice | |
| 4,678,234 | A | | 7/1987 | Wilson | |
| 4,759,542 | A | | 7/1988 | Hudec | |
| 4,787,630 | A | | 11/1988 | Watson et al. | |
| 4,801,140 | A | | 1/1989 | Bergeron | |
| 4,880,226 | A | | 11/1989 | Krantz | |
| D306,049 | S | * | 2/1990 | Bancroft | D21/688 |
| 4,905,994 | A | | 3/1990 | Hartz | |
| D313,521 | S | | 1/1991 | Hassel et al. | |
| 5,048,823 | A | | 9/1991 | Bean | |
| 5,066,001 | A | | 11/1991 | Wilkinson | |
| 5,116,045 | A | | 5/1992 | Jahoda | |
| 5,118,096 | A | | 6/1992 | Wilkinson et al. | |
| 5,125,880 | A | * | 6/1992 | Peters | 482/68 |
| 5,135,450 | A | * | 8/1992 | Smith, IV | 482/80 |
| D330,057 | S | | 10/1992 | Saunders et al. | |
| D330,234 | S | | 10/1992 | Saunders et al. | |
| 5,154,678 | A | | 10/1992 | Adamczyk et al. | |
| 5,162,028 | A | | 11/1992 | Wilkinson | |
| 5,169,360 | A | | 12/1992 | Saunders | |
| 5,176,596 | A | | 1/1993 | Ullman | |
| 5,184,987 | A | | 2/1993 | Wilkinson | |
| 5,203,279 | A | | 4/1993 | Eversdyk | |
| 5,213,554 | A | | 5/1993 | Goldstein et al. | |
| 5,230,674 | A | | 7/1993 | Terauds | |
| 5,232,426 | A | | 8/1993 | Van Straaten | |
| 5,261,864 | A | | 11/1993 | Fitzpatrick | |
| 5,277,675 | A | | 1/1994 | Shifferaw | |
| 5,294,180 | A | | 3/1994 | Grimm | |
| 5,318,489 | A | | 6/1994 | Irwin | |
| 5,330,399 | A | * | 7/1994 | Fan | 482/34 |
| D353,419 | S | | 12/1994 | Sprague | |
| 5,387,166 | A | | 2/1995 | Gvoich | |
| D357,517 | S | | 4/1995 | Traetta | |
| D360,664 | S | | 7/1995 | Stone | |
| 5,441,466 | A | | 8/1995 | Piaget et al. | |
| 5,470,292 | A | | 11/1995 | Simon | |
| 5,472,390 | A | | 12/1995 | Faye | |
| D367,369 | S | | 2/1996 | Lovegrove et al. | |
| 5,492,520 | A | * | 2/1996 | Brown | 482/140 |
| 5,499,417 | A | | 3/1996 | Wang | |
| D371,176 | S | | 6/1996 | Furner | |
| 5,529,562 | A | | 6/1996 | Glaser | |
| 5,536,072 | A | * | 7/1996 | Chang | 297/423.45 |
| 5,549,536 | A | | 8/1996 | Clark | |
| 5,558,603 | A | | 9/1996 | Simon | |
| 5,562,575 | A | | 10/1996 | Gvoich | |
| 5,575,740 | A | * | 11/1996 | Piaget et al. | 482/70 |
| 5,584,779 | A | | 12/1996 | Knecht et al. | |
| 5,591,105 | A | | 1/1997 | Dalebout et al. | |
| 5,605,526 | A | * | 2/1997 | Hatfield | 482/142 |
| 5,620,404 | A | | 4/1997 | Eyman | |
| 5,645,511 | A | | 7/1997 | LeRoux et al. | |
| 5,656,000 | A | | 8/1997 | Russell | |
| 5,658,226 | A | | 8/1997 | Mentz | |
| 5,672,144 | A | | 9/1997 | Hulme | |
| 5,683,331 | A | | 11/1997 | Dalebout | |
| 5,730,690 | A | | 3/1998 | Guidry | |
| 5,735,778 | A | * | 4/1998 | Piaget | 482/114 |
| 5,795,276 | A | * | 8/1998 | Almeda | 482/142 |
| 5,810,703 | A | | 9/1998 | Stack | |
| 5,833,584 | A | * | 11/1998 | Piaget et al. | 482/70 |
| 5,855,538 | A | * | 1/1999 | Argabright | 482/70 |
| D405,135 | S | * | 2/1999 | Scott | D21/688 |
| 5,879,272 | A | | 3/1999 | Mekjian | |
| 5,897,474 | A | * | 4/1999 | Romero | 482/146 |
| 5,941,806 | A | * | 8/1999 | Olschansky et al. | 482/140 |
| 6,012,188 | A | | 1/2000 | Daniels et al. | |
| D420,407 | S | | 2/2000 | Garcia et al. | |
| 6,039,658 | A | | 3/2000 | Cecchin | |
| 6,063,014 | A | | 5/2000 | Scoggins | |
| 6,110,083 | A | | 8/2000 | Riser | |
| 6,117,051 | A | | 9/2000 | Suarez et al. | |
| 6,149,555 | A | | 11/2000 | Kinback | |
| 6,206,805 | B1 | | 3/2001 | Helton et al. | |
| 6,245,001 | B1 | | 6/2001 | Siaperas | |
| 6,299,569 | B1 | | 10/2001 | Rich | |
| 6,312,361 | B1 | | 11/2001 | Hayes | |
| 6,312,364 | B1 | | 11/2001 | Selsam | |
| 6,389,883 | B1 | | 5/2002 | Beme et al. | |
| 6,413,197 | B2 | | 7/2002 | McKechnie et al. | |
| 6,419,611 | B1 | | 7/2002 | Levine et al. | |
| 6,422,983 | B1 | | 7/2002 | Weck | |
| 6,461,285 | B1 | * | 10/2002 | Theunissen et al. | 482/146 |
| 6,551,225 | B1 | | 4/2003 | Romero | |
| 6,558,301 | B1 | | 5/2003 | Jackson | |
| 6,575,885 | B1 | | 6/2003 | Weck et al. | |
| 6,592,500 | B1 | * | 7/2003 | McBride et al. | 482/140 |
| 6,634,998 | B2 | | 10/2003 | Siaperas | |
| 6,702,726 | B2 | | 3/2004 | Lin | |
| 6,719,676 | B1 | | 4/2004 | Hsu | |
| D489,778 | S | | 5/2004 | Fan et al. | |
| 6,740,008 | B1 | | 5/2004 | Ho et al. | |
| 6,872,175 | B2 | | 3/2005 | Lin | |
| D505,460 | S | | 5/2005 | Dalebout et al. | |
| 6,908,417 | B2 | | 6/2005 | Jackson | |
| D507,608 | S | | 7/2005 | Chen | |
| 6,926,643 | B1 | | 8/2005 | Gvoich | |
| 6,929,588 | B2 | | 8/2005 | Hobson | |
| 6,935,992 | B2 | * | 8/2005 | Gehrke | 482/146 |
| 6,988,979 | B1 | | 1/2006 | Trainor | |
| 7,001,316 | B2 | | 2/2006 | Jakobs et al. | |
| D517,136 | S | * | 3/2006 | Chen | D21/688 |
| 7,008,359 | B2 | | 3/2006 | Fan et al. | |
| 7,052,449 | B2 | | 5/2006 | Chen | |
| 7,112,168 | B2 | | 9/2006 | Dalebout et al. | |
| 7,207,931 | B2 | * | 4/2007 | Boland | 482/126 |
| 2002/0077231 | A1 | * | 6/2002 | Dalebout et al. | 482/146 |
| 2002/0137610 | A1 | | 9/2002 | Broudy et al. | |

2003/0045410 A1 3/2003 Kao
2003/0109365 A1* 6/2003 Smith ..... 482/146
2003/0207738 A1 11/2003 Wong
2004/0241631 A1* 12/2004 Nizamuddin ..... 434/253
2005/0020418 A1 1/2005 Lin
2005/0049123 A1 3/2005 Dalebout et al.
2005/0049125 A1 3/2005 Cloutier et al.
2006/0040796 A1 2/2006 Holloway
2006/0128540 A1 6/2006 Engle
2006/0211544 A1* 9/2006 Loane ..... 482/70
2007/0087902 A1 4/2007 Penat et al.
2008/0318743 A1 12/2008 Bizzell et al.

* cited by examiner

EXERCISE DEVICES

The present application is a U.S. nonprovisional patent application of, and claims priority under 35 U.S.C. § 119(e) to, U.S. provisional patent application Ser. No. 60/864,437, filed Nov. 6, 2006, which provisional patent application is incorporated by reference herein.

COPYRIGHT STATEMENT

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

BACKGROUND OF THE INVENTION

The present invention generally relates to an exercise device, and more particularly to a versatile exercise device capable of supporting a user thereon for performing various exercises.

Exercise devices are known that are intended to provide balance and strength training for a person's core muscles, i.e., the muscles of the abdomen and back that are often associated with providing balance, stability and a straight posture. Such devices often include an unsteady platform member upon which a person is to stand and attempt to keep his or her balance. The platform may rotate, tilt, twist or move in some combination of these motions or some other motion that tends to make the user unsteady on the platform. By regaining balance, a person is exercising his core muscles. Examples of patents disclosing an exercise device for core strengthening or balance devices include U.S. Pat. Nos. 4,183,521 and 7,008,359.

In addition, exercise devices are known that provide a step device upon which a person may step on and step off in order to perform cardiovascular exercises. Such step devices may be used for various other strength training devices as will be obvious to one of ordinary skill in the art upon viewing such devices. These step devices may include the ability to adjust the height of the step or may include a step surface that includes a cushion or some other resilient surface upon which a user will step. Examples of patents disclosing exercise devices providing a step device include U.S. Pat. Nos. 5,683,331 and 5,562,575. U.S. Patent Application Publication No. 2006/0040796 also discloses an exercise device providing a step.

While these devices perform their intended functions, a need exists for a more versatile exercise device that enables a person to have a complete workout experience with a single device, i.e., a single device that may be used for stretching, core strength training, balance training, cardiovascular exercise, and strength training.

SUMMARY OF THE INVENTION

The present invention includes many aspects and features. Accordingly, one aspect of the present invention relates to an exercise device. The exercise device comprises a frame, including a pair of arcuate rails having a central curved portion, a first end, and a second end. The pair of rails are disposed in fixed parallel relation with one another with a first end member interconnecting the first ends of the rails and a second end member interconnecting the second ends of the rails. The device further comprises a platform operatively connected to the frame for supporting a person thereon. The device may be oriented in various orientations, including: a rocking orientation wherein the curved portions of the pair of rails abut a surface on which the device is placed such that the device may move in a rocking motion relative to the surface, and a stationary orientation wherein the first end member and the second end member abut the surface on which the device is placed such that the device is stationary relative to the surface.

In a feature of this aspect, the exercise device includes a pair of handles. In an additional feature, the exercise device includes a pair of hooks. In accordance with this feature, the exercise device includes two pairs of hooks.

In an additional feature, each rail of the pair of rails may alternate between a plurality of positions. With further regard to this feature, one of the plurality of positions is a curved position. In accordance with this feature, one of the plurality of positions is a release position.

In a further feature, each rail of the pair of rails includes a button. In another feature, the platform has a first end, a second end, and a generally planar central portion. In addition, the first end of the platform is connected to the frame near the first end of the frame, and the second end of the platform is connected to the frame near the second end of the frame.

In a second aspect, an exercise device comprises a pair of arcuate rails having a central curved portion, a first end, and a second end. The pair of rails are disposed in fixed parallel relation with one another with a first end member interconnecting the first ends of the rails and a second end member interconnecting the second ends of the rails. The central curved portions are operative in one of a plurality of positions, including: a curved position, wherein the curved portions of the rails follow the arcuate curvature of the pair of rails, and a release position, wherein the curved portions of the rails are shifted directionally away from the arcuate curvature of the pair of rails such that they form curved dips in each rail of the pair of rails, respectively.

In a feature of this aspect, the device further includes a button on each rail of the pair of rails. With regard to this feature, the buttons are used to move the central curved portions of the rails between the plurality of positions.

In a third aspect, an exercise device comprises a frame and a platform centrally supported by the frame for receipt of a person thereon for exercising. The device may be oriented in various orientations, including: a rocking orientation wherein the device may move in a rocking motion relative to a surface on which the device is placed, and a stationary orientation wherein the device is stationary relative to the surface on which it is placed.

A method of exercising with the exercise device includes beginning exercising by standing on the platform in the stationary orientation, beginning exercising by sitting on the platform in the stationary orientation, beginning exercising by standing on the platform in the rocking orientation, beginning exercising by sitting on the platform in the rocking orientation, grasping a portion of the frame while exercising using the device, and using an exercise band in combination with the device.

In addition to the aforementioned aspects and features of the present invention, it should be noted that the present invention further includes the various possible combinations of such aspects and features. Examples of such combinations are illustrated in the detailed description set forth below.

BRIEF DESCRIPTION OF THE DRAWINGS

One or more preferred embodiments of the present invention now will be described in detail with reference to the accompanying drawings, wherein the same elements are referred to with the same reference numerals, and wherein.

DETAILED DESCRIPTION

Figure 1:
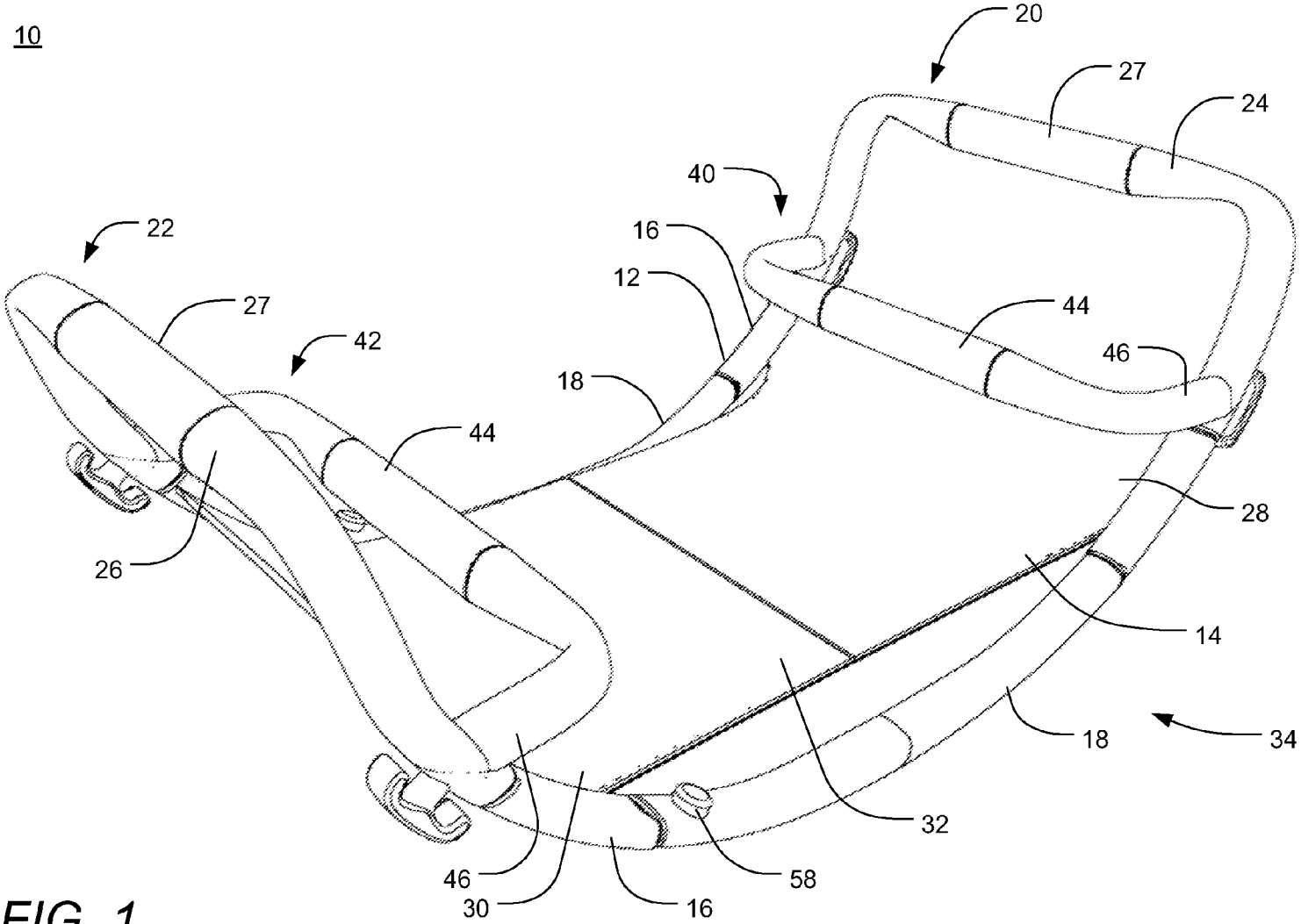
FIG. 1 is a perspective view of an exercise device in accordance with an embodiment of the present invention, in a rocking orientation.

As a preliminary matter, it will readily be understood by one having ordinary skill in the relevant art ("Ordinary Artisan") that the present invention has broad utility and application. Furthermore, any embodiment discussed and identified as being "preferred" is considered to be part of a best mode contemplated for carrying out the present invention. Other embodiments also may be discussed for additional illustrative purposes in providing a full and enabling disclosure of the present invention. Moreover, many embodiments, such as adaptations, variations, modifications, and equivalent arrangements, will be implicitly disclosed by the embodiments described herein and fall within the scope of the present invention.

Accordingly, while the present invention is described herein in detail in relation to one or more embodiments, it is to be understood that this disclosure is illustrative and exemplary of the present invention, and is made merely for the purposes of providing a full and enabling disclosure of the present invention. The detailed disclosure herein of one or more embodiments is not intended, nor is to be construed, to limit the scope of patent protection afforded the present invention, which scope is to be defined by the claims and the equivalents thereof. It is not intended that the scope of patent protection afforded the present invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection afforded the present invention is to be defined by the appended claims rather than the description set forth herein.

Additionally, it is important to note that each term used herein refers to that which the Ordinary Artisan would understand such term to mean based on the contextual use of such term herein. To the extent that the meaning of a term used herein—as understood by the Ordinary Artisan based on the contextual use of such term—differs in any way from any particular dictionary definition of such term, it is intended that the meaning of the term as understood by the Ordinary Artisan should prevail.

Furthermore, it is important to note that, as used herein, "a" and "an" each generally denotes "at least one," but does not exclude a plurality unless the contextual use dictates otherwise. Thus, reference to "a picnic basket having an apple" describes "a picnic basket having at least one apple" as well as "a picnic basket having apples." In contrast, reference to "a picnic basket having a single apple" describes "a picnic basket having only one apple."

When used herein to join a list of items, "or" denotes "at least one of the items," but does not exclude a plurality of items of the list. Thus, reference to "a picnic basket having cheese or crackers" describes "a picnic basket having cheese without crackers", "a picnic basket having crackers without cheese", and "a picnic basket having both cheese and crackers." Finally, when used herein to join a list of items, "and" denotes "all of the items of the list." Thus, reference to "a picnic basket having cheese and crackers" describes "a picnic basket having cheese, wherein the picnic basket further has crackers," as well as describes "a picnic basket having crackers, wherein the picnic basket further has cheese."

Referring now to the drawings, one or more preferred embodiments of the present invention are next described. The following description of one or more preferred embodiments is merely exemplary in nature and is in no way intended to limit the invention, its applications, or uses.

Figure 2:
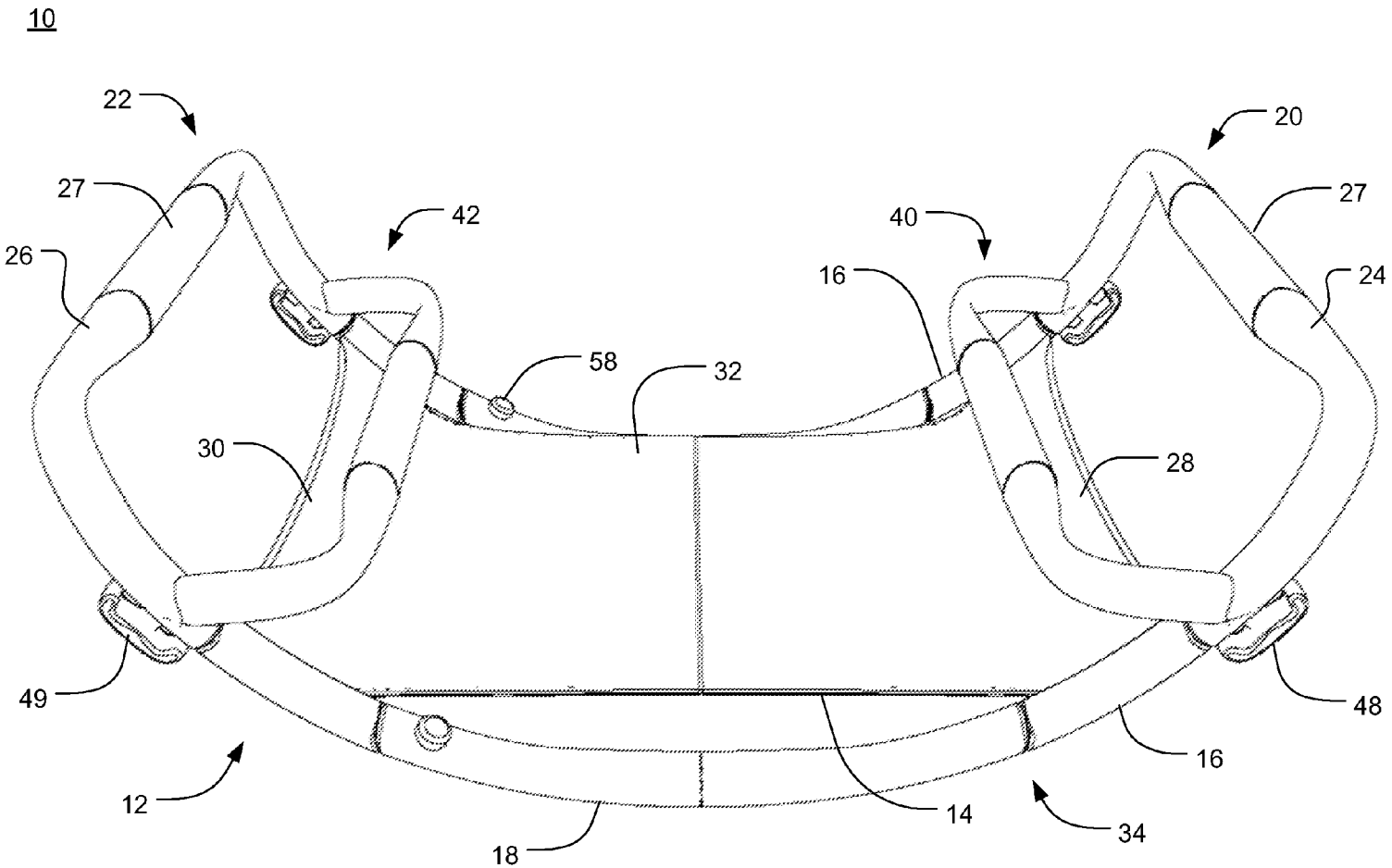
FIG. 2 is a side view of the exercise device of FIG. 1.

Turning now to FIGS. 1 and 2, which are illustrative views of an exercise device in accordance with an embodiment of the present invention, the exercise device 10 comprises a frame 12 and a platform 14. The frame 12 includes a pair of arcuate rails 16 having a central curved portion 18, a first end 20, and a second end 22. The pair of rails 16 are disposed in fixed parallel relation with one another. A first end member 24 of the frame 12 interconnects the first ends 20 of the rails 16, and a second end member 26 of the frame 12 interconnects the second ends 22 of the rails 16. The end members 24,26 are relatively narrow rail-like members that are fixedly connected at ends thereof to the ends 20,22 of the arcuate rails 16. The end members 24,26 generally have a rounded rectangular cross-section, i.e., the corners of the rectangular cross-section are rounded, near a central portion thereof and then taper near the ends thereof. Generally, a right angle is formed at the connection point between the end members 24,26 and the rails 16, however, the connection point is rounded rather than sharp in order to make the device 10 more aesthetically pleasing and more safe for users. It is contemplated that each of the end members 24,26 may have a central grasping area 27 that is slightly recessed or composed of a different material than the rest of the end member 24,26 such that a user may more easily grasp the end member 24,26.

The platform 14 is generally rectangular in shape and has a first end 28, a second end 30, and a generally planar central portion 32. The first end 28 of the platform 14 is fixedly connected to the frame 12 near the first end 20 of the frame 12, and the second end 30 of the platform 14 is fixedly connected to the frame 12 near the second end 22 of the frame 12. The platform 14 interconnects the rails 16 of the frame 12 and is arranged such that it may support a person thereon. More particularly, a horizontal plane of the central portion 32 of the platform 14 is orthogonal to a vertical plane of each of the rails 16, with the width of the central portion 32 of the platform 14 substantially spanning the distance between the rails 16 of the frame 12. The width of the platform 14 broadens near the ends 28,30 thereof to enable the platform 14 to connect to the frame 12. While the central portion 32 of the platform 14 is generally planar, the ends 28,30 of the platform 14 curve to mimic the curvature of the rails 16 to enable the ends 28,30 of the platform 14 to connect with the frame 12 without obstructing the central portion 32. With this connection arrangement, the area available on the central portion 32 of the platform 14 is not compromised or obstructed by connecting the platform 14 to the frame 12. Therefore, a maximum available area is provided by the platform 14 for a person to use when exercising with the device 10.

The exercise device 10 may be used in various orientations. Such orientations include: 1) a rocking orientation 34 wherein the curved portions 18 of the pair of rails 16 are resting on a surface on which the device 10 is placed, such that the device 10 may move in a rocking motion relative to the surface and 2) a stationary orientation 36 wherein the first end member 24 and the second end member 26 are resting on the surface on which the device 10 is placed such that the device 10 is stationary relative to the surface. Typically, the surface on which the device 10 is placed is a floor.

FIGS. 1 and 2 show the exercise device 10 in the rocking orientation 34. When the device 10 is in the rocking orientation 34, the end members 24,26 are pointed upwardly away from the surface on which in the device 10 is placed, and a surface of the platform 14 is available for support of a person using the device 10, the rocking orientation surface. In general, the side of the device 10 that is facing upwardly, away from the surface on which the device is placed when the device 10 is in the rocking orientation 34 is the rocking side of the device 10.

In the rocking orientation 34, a pair of handles 40,42 that are integrally connected to the rocking side of the frame 12 are readily accessible to a person using the device 10. A first handle 40 is disposed substantially adjacent the first end 28 of the platform 14, near the first end 20 of the frame 12; and a second handle 42 is disposed substantially adjacent the second end 30 of the platform 14, near a second end 22 of the frame 12. Each of the handles 40,42 has a grasping portion 44 and two arm portions 46 integrally connected to the grasping portion 44 in general orthogonal relation therewith at ends of the grasping portion 44. The grasping portions 44 of the handles 40,42 are similar in configuration to the end members 24,26 of the frame 12, i.e., the grasping portions 44 are relatively narrow rail-like members with a central area having a generally rounded rectangular cross-section and then taper near ends thereof. It is contemplated that a central portion of the grasping portion 44 of each of the handles 40,42 is slightly recessed or composed of a different material than the rest of the handle 40,42 such that a user may more easily grasp the handle 40,42. The arm portions 46 of the handles 40,42 integrally connect the handles 40,42 to the frame 12. The handles 40,42 are connected to the frame 12 such that horizontal planes of the handles 40,42 are generally parallel with the surface on which the exercise device 10 is placed when the device 10 is at rest in the rocking orientation 34. If a person is using the device 10 in the rocking orientation 34, it may be tilted along the rails 16 such that the handles 40,42 are no longer parallel with the surface.

Figure 3:
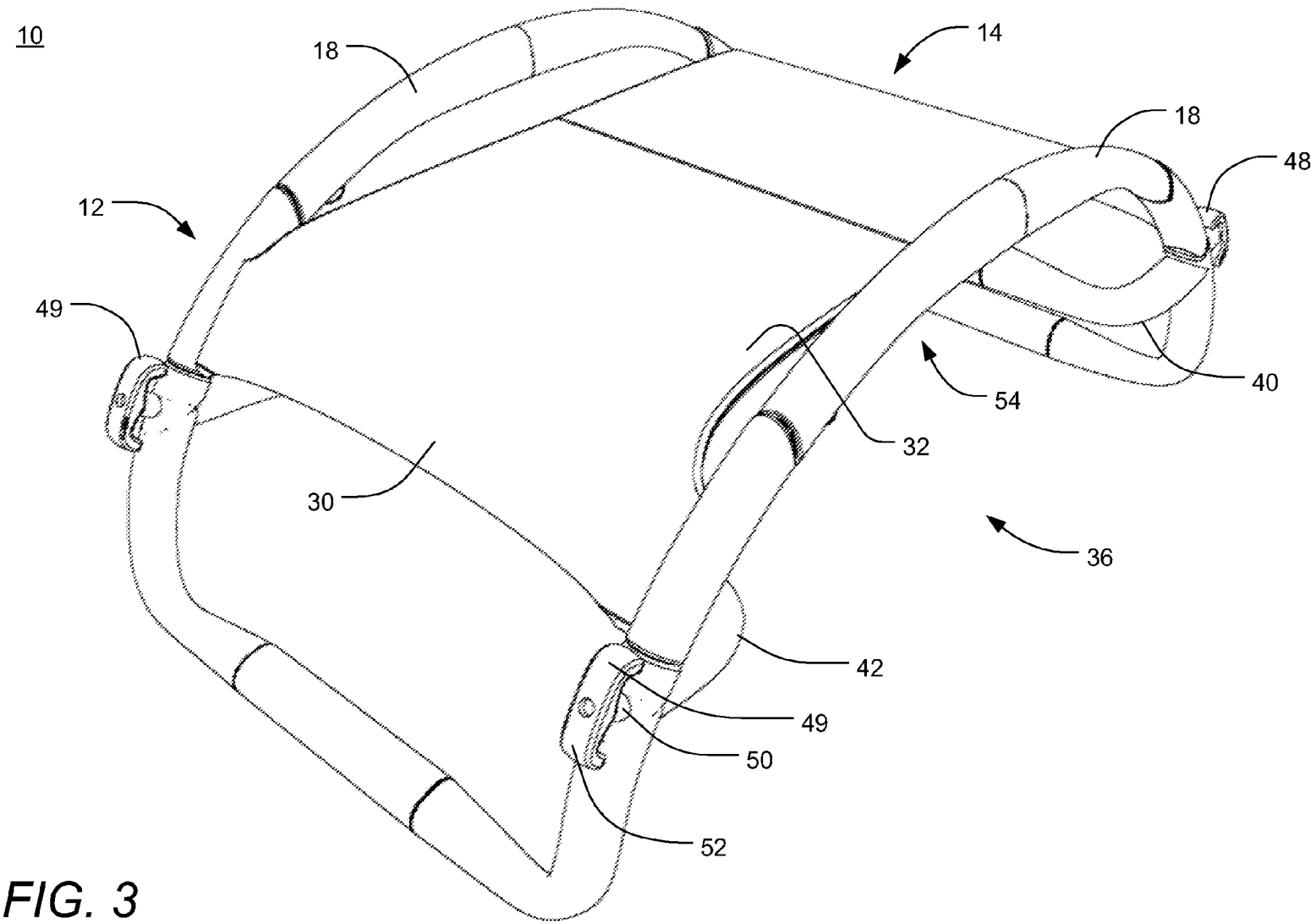
FIG. 3 is a perspective view of the exercise device of FIG. 1, in a stationary orientation.

FIG. 3 shows the device 10 in the stationary orientation 36. When the device 10 is in the stationary orientation 36, the central curved portion 18 of the rails 16 are pointed upwardly away from the surface, and a surface of the platform 14 is available for support of a person using the device 10, the stationary orientation surface. In general, the side of the device 10 that is facing upwardly, away from the surface on which the device 10 is placed when the device 10 is in the stationary orientation 36 is the stationary side of the device 10.

In the stationary orientation 36, two pairs of hooks 48,49 are connected to the stationary side of the frame 12 such that they are readily accessible to a user. A first pair of hooks 48 is disposed, one on each rail 16, substantially adjacent the first end 28 of the platform 14, near the first end 20 of the frame 12; and a second pair of hooks 49 is disposed, one on each rail 16, substantially adjacent the second end 30 of the platform 14, near a second end 22 of the frame 12. Each of the hooks 48,49 is generally T-shaped with a vertical member 50 of the T connecting the hook 48,49 to its respective rail 16 and ends of the cross member 52 of the T being curved toward the respective rail 16 of the hook 48,49. Although the hooks 48,49 are readily accessible when the device 10 is in the stationary orientation 36, they are also accessible and may be used when the device 10 is in any orientation. It is contemplated that the hooks 48,49 will be used to operatively connect auxiliary exercise tools with the device 10 for use when exercising. Examples of auxiliary devices include, but are not limited to, exercise bands, tubes, and cords.

Figure 4:
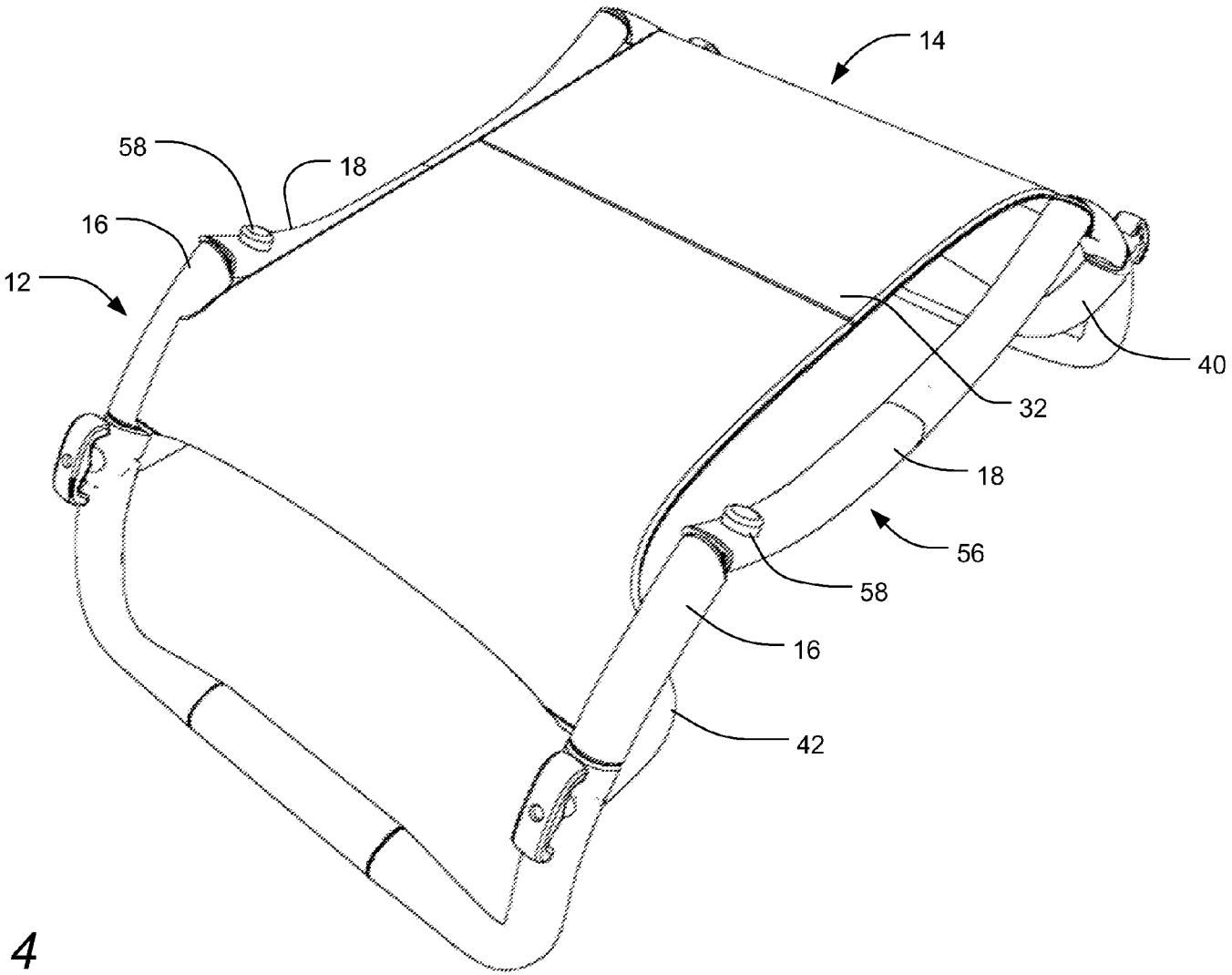
FIG. 4 is a perspective view of the exercise device of FIG. 3 with the rails in an alternative position.
Figure 5:
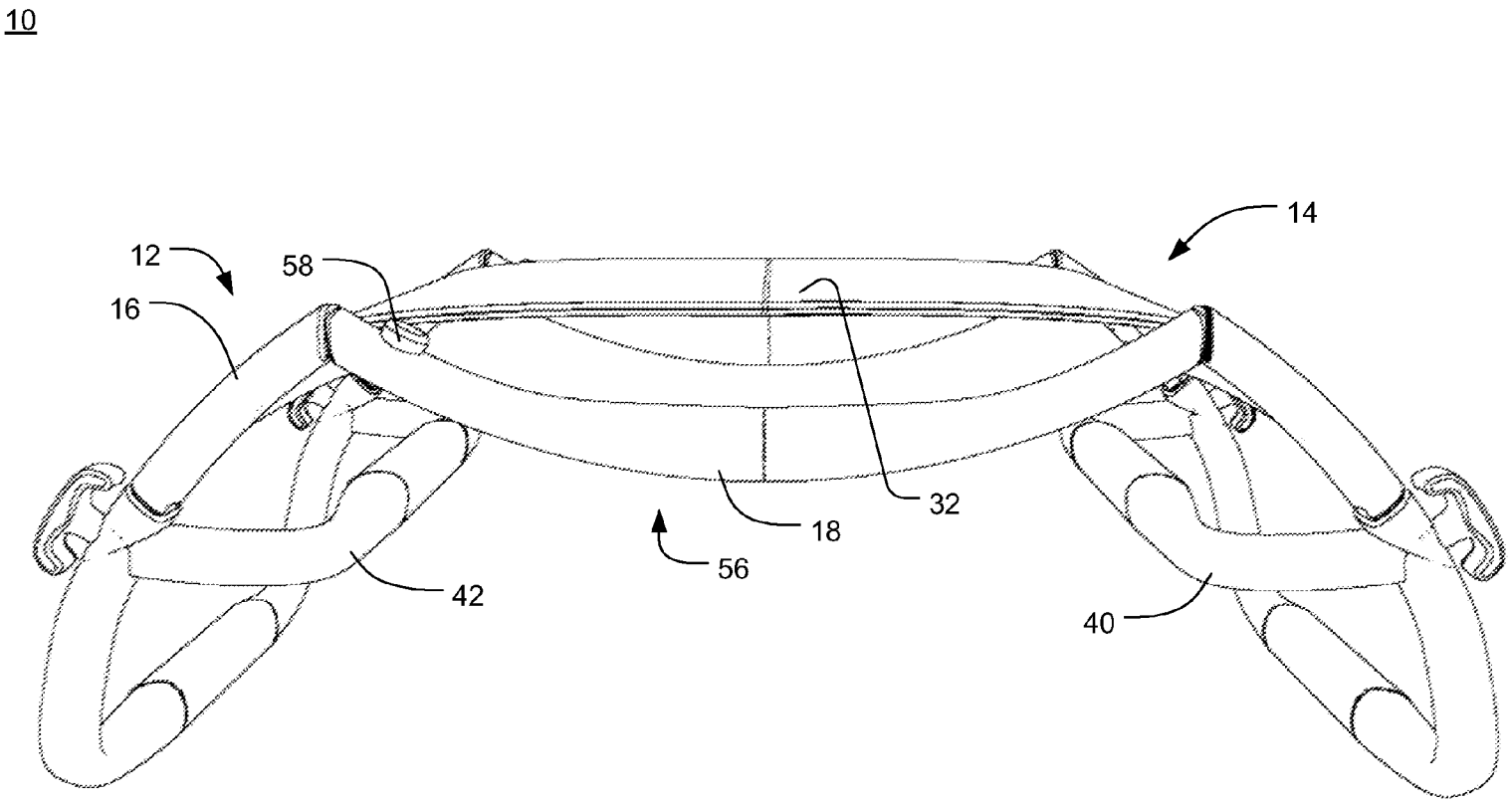
FIG. 5 is a side view of the exercise device of FIG. 4.

The rails 16 of the frame 12 are capable of alternating between two operative positions, which are illustrated in FIGS. 3 and 4. More particularly, the central portions 18 of the rails 16 may alternate between one of two positions: a curved position 54 and a release position 56. FIG. 3 shows the rails 16 in the curved position 54. In the curved position 54, the curved portions 18 of the rails 16 follow the arcuate curvature of the pair of rails 16. The curved position 54 is particularly useful when the device 10 is in the rocking orientation 34. In fact, the curved position 54 enables rocking of the device 10.

FIG. 4 shows the rails 16 in the release position 56. In the release position 56, the curved portions 18 of the rails 16 are shifted directionally away from the arcuate curvature of the pair of rails 16 such that they form curved dips in each rail 16 of the pair of rails 16, respectively. The release position 56 is particularly useful when the device 10 is in the stationary orientation 36 because the curved portions 18 of the rails 16 would obstruct access to the platform 14 if the rails 16 remained in the curved position 54. When the curved portions 54 are shifted to the release position 56, they are folded away from the platform 14 surface thereby providing unobstructed access to it.

To enable switching of the curved portions 18 between the curved position 54 and the release position 56, a release button 58 is disposed on each of the curved portions 18 of the rails 16. When the curved portion 18 is in the curved position 54, the button 58 is disposed on the rocking side of the device 10. Therefore, when the device 10 is in the rocking orientation 34 and the curved portion 18 is in the curved position 54, the button 58 is facing upwardly away from the surface on which the device 10 is placed. As such, the button 58 will not be accidentally depressed by the surface when the device 10 is rocking back and forth on the surface.

When the curved portion 18 transitions to the release position 56, it folds such that the button 58 is disposed on the stationary side of the device 10. Therefore, when the device 10 is in the stationary orientation 36 and the curved portion 18 is in the release position 56, the button 58 is facing upwardly away from the surface on which the device 10 is placed. This enables a user to easily access the button 58 to switch the curved portion 18 to the curved position 54. It is contemplated that the button 58 may be arranged on the curved portion 18 such that it is recessed into the rail 16 at the curved portion 18 thereof. This recessed placement may further protect the button 58 from being inadvertently depressed and may be more aesthetically pleasing.

To enable alternating between the curved position 54 and the release position 56, the curved portions 18 of the rails 16 are connected to remaining portions of the rails 16 with a connection mechanism that enables the curved portion 18 to pivot relative to the remaining portions of the rails 16. When the curved portion 18 is pivoting between the curved position 54 and the release position 56, it bows such that that the release button 58 is facing the platform 14 as the curved portion 18 moves between positions 54,56. It is contemplated that the rails 16 may have a third position, wherein the curved portion 18 is arranged such that it is generally horizontally aligned with the platform 14.

It is desirable for the frame 12 and platform 14 to be constructed of a sturdy, but lightweight material. It is contemplated that the frame 12 and platform 14 will be constructed of plastic. An example includes low density polypropylene. In addition, the frame 12 may be constructed of nylon filled Acrylonitrile Butadiene Styrene (ABS) or aluminum.

Figures 6A, 6B, 6C, 6D, 6E, 6F, 6G, 6H, 6I, 6J, 6K, 6L, 6M:
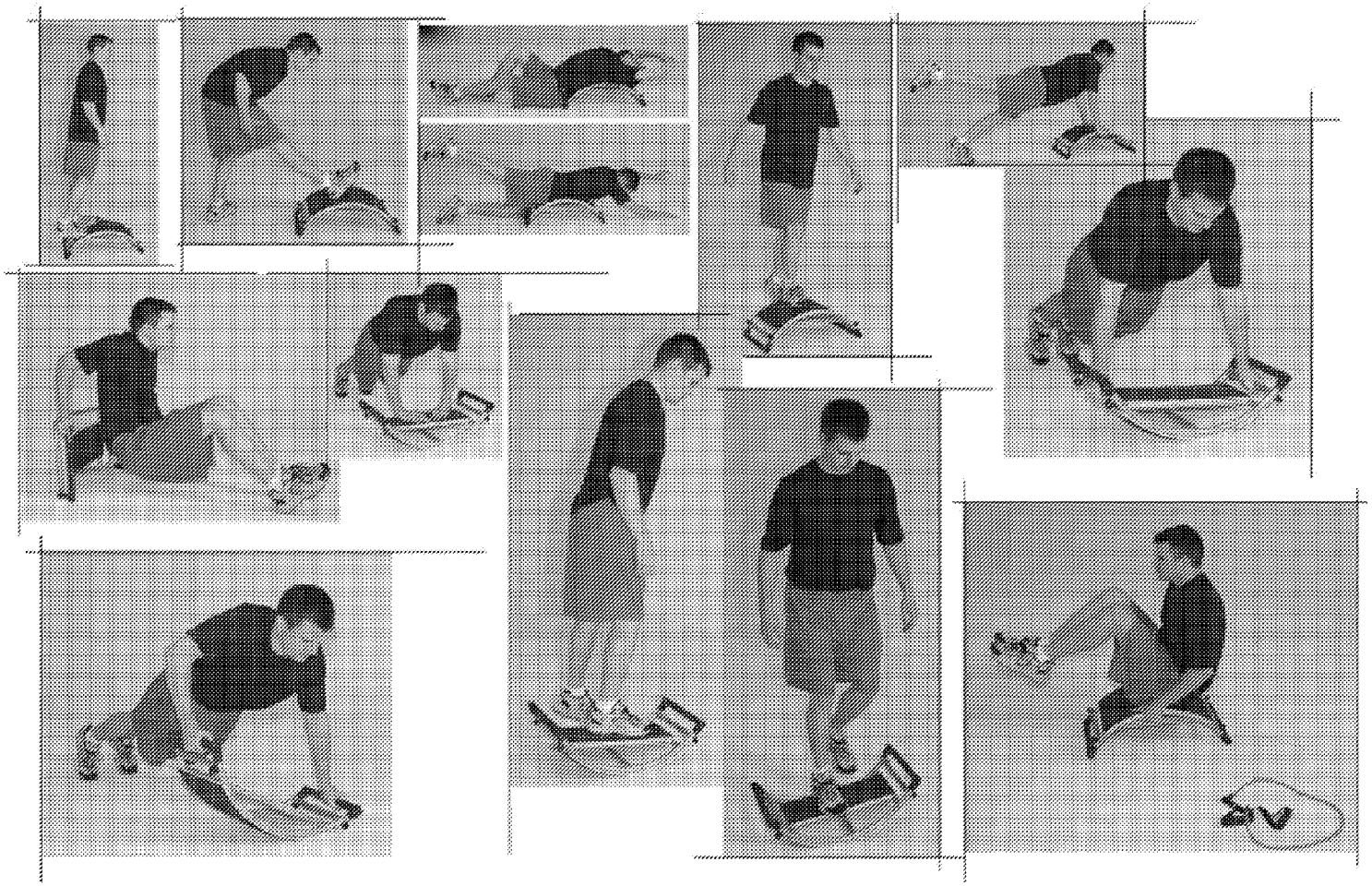
FIGS. 6A-6Z are photographs illustrating various exercise positions that may be performed with the exercise device of the present invention.
Figures 6N, 6O, 6P, 6Q, 6R, 6S, 6T, 6U, 6V, 6W, 6X, 6Y, 6Z:
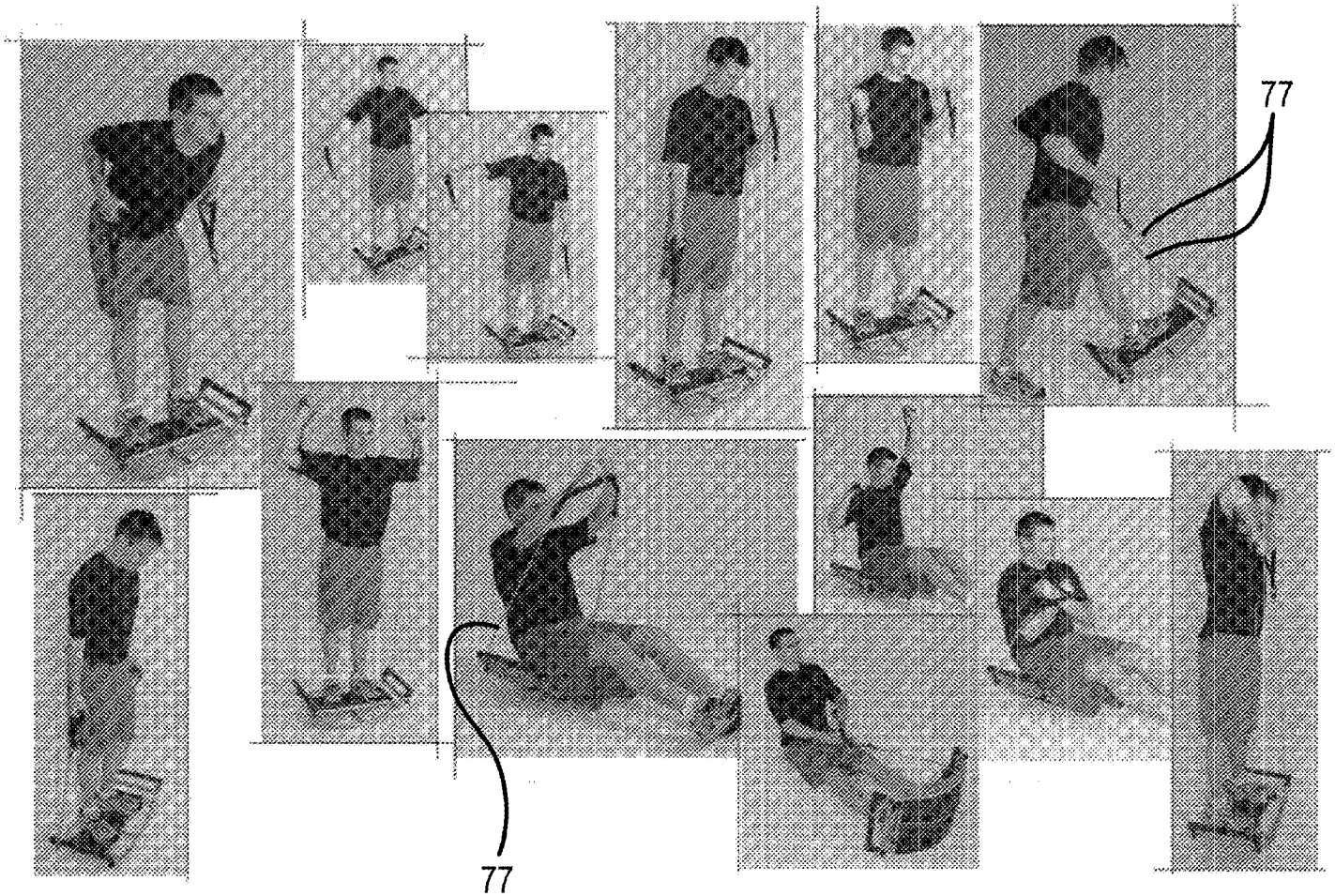

The exercise device 10 is incredibly versatile and may be used for various kinds of exercise including stretching, core training, cardiovascular training and general strength training. FIGS. 6A-6Z are photographs illustrating various exercise positions that may be performed on an exercise device of the present invention. The device used in the photographs is an alternative embodiment of the exercise device. Although, the embodiment used in the photographs is not the device 10 described fully herein, it includes the functional features of device 10. Each of the exercises shown in the photographs may be performed with the device 10.

Many stretching exercises may be performed with the device 10 when it is in the stationary orientation 36. For example, a person may use the platform 14 to do calf stretches and hamstring stretches by placing a foot on the platform 14 and stretching accordingly. In addition, a person may lie with his or her back across the platform 14 to stretch his or her back.

Many core training exercises may be performed with the device 10 when it is in the rocking orientation 34. A person may step onto and off of the platform 14 in a forward and backward direction and in a side to side direction. A person may place his or her hands on the handles 40,42 or on the end members 24,26 and do push ups while rocking the device 10 or simply trying to keep the device 10 from rocking. In addition, a person may stand on the platform 14 and perform various arm exercises such as bicep curls, rows, shoulder presses, and the like with exercise bands 77. In this scenario, the person is exercising his arms with the band but also exercising his core by keeping the device 10 from rocking while performing the arm exercises. Similarly, a person may sit on the platform 14 and perform similar exercises with an exercise band 77.

The device 10 may used in the stationary orientation 36 as a step device for performing step aerobic-type exercises. However, simply stepping up and down, on to and off of the platform 14 provides a cardiovascular workout.

The device 10 may be used in the stationary orientation 36 to perform various forms of sit up exercises for strength training purposes. In addition, a person may perform push up exercises with the device 10 in the stationary orientation 36 for strength training purposes.

Further, the device 10 may be used in other orientations than the rocking orientation 34 and the stationary orientation 36. For example, the device 10 may be turned on its side, such that the platform 14 is orthogonal to the surface on which the device 10 is placed. In this side orientation, a person may place his or her feet on the platform 14, connect an exercise band to the device 10 and perform various pulling arm exercises with the band. Additionally, a person may sit with his back to the device 10, place his hands on a rail 16 of the device 10 with his legs outstretched in front of him, and perform dip exercises to strengthen his tricep muscles.

The list of exercises provided herein is simply exemplary, and is not exhaustive of the numerous exercises that can be performed with the exercise device 10.

Figure 7:
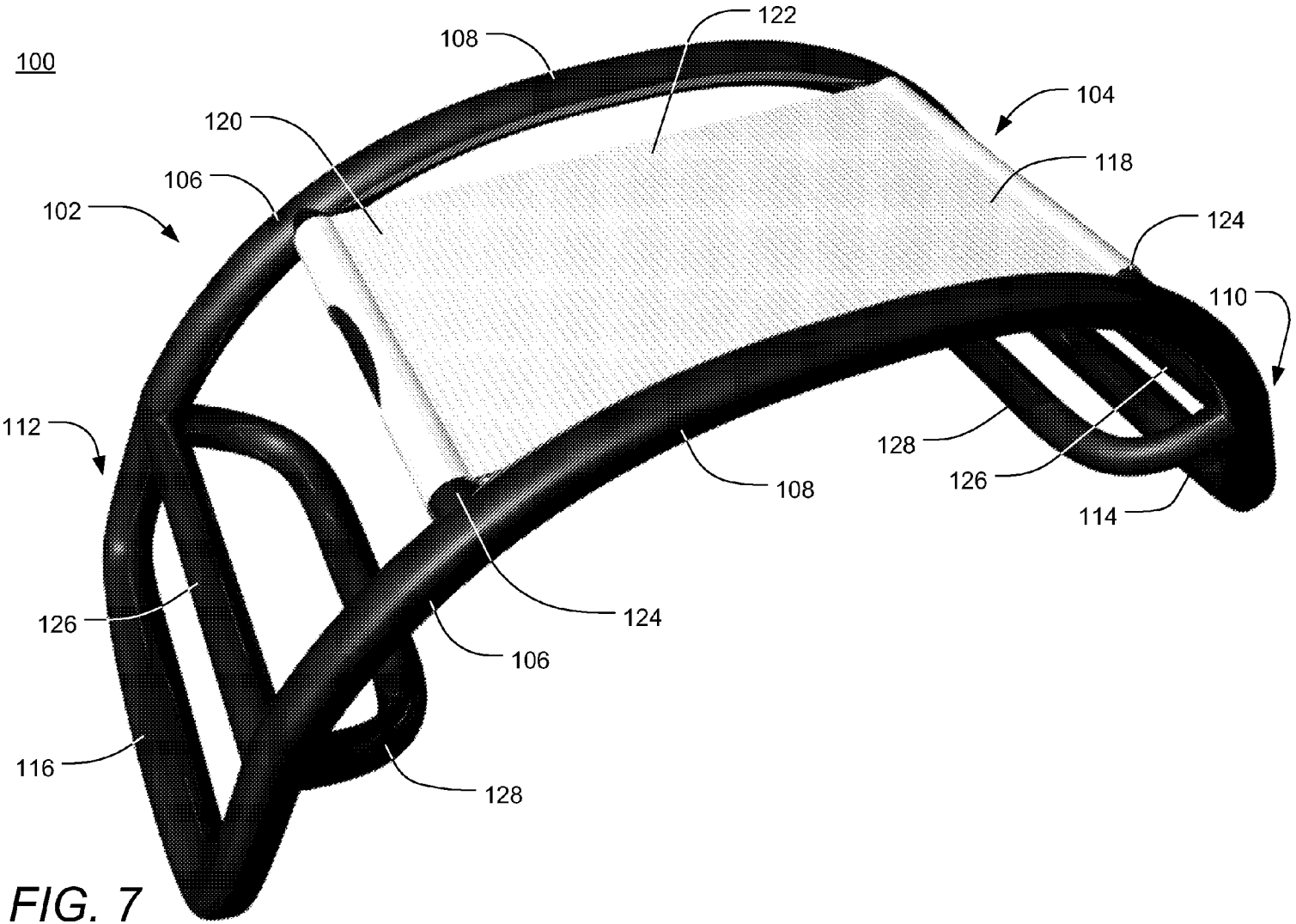
FIG. 7 is a perspective view of an exercise device in accordance with another embodiment of the present invention, in a stationary orientation.

FIG. 7 is a perspective view of an exercise device 100 in accordance with another embodiment of the present invention. The exercise device 100 comprises a frame 102 and a platform 104. The frame 102 includes a pair of arcuate rails 106 having a central curved portion 108, a first end 110, and a second end 112. The pair of rails 106 are disposed in fixed parallel relation with one another. A first end member 114 of the frame 102 interconnects the first end 110 of the rails 106, and a second end member 116 of the frame 102 interconnects the second end 112 of the rails 106. The end members 114, 116 are relatively narrow rail-like members that are fixedly connected at ends thereof to the ends of the arcuate rails 106. Generally, a right angle is formed at the connection point between the end members 114,116 and the rails 106, however, the connection point is rounded rather than sharp in order to make the device 100 more aesthetically pleasing and more safe for users.

The platform 104 is generally rectangular in shape and has a first end 118, a second end 120, and a generally planar central portion 122. The platform 104 is supported by a pair of cross connection bars 124, which are connected to the first end 118 and the second end 120 of the platform 104, respectively, and are fixedly connected to the frame 102 in orthogonal relation thereto. Therefore, the platform 104 is arranged such that it may support a person thereon between the rails 106 of the frame 102. A horizontal plane of the central portion 122 of the platform 104 is orthogonal to a vertical plane of each of the rails 106, with the width of the central portion 122 of the platform 104 substantially spanning the distance between the rails 106 of the frame 102. The device 100 includes a pair of handles 128 integrally connected to the frame 102 in a similar manner as the handles 40,42 of device 10.

This device 100 is intended to be more simple in design than the previously described device 10, and therefore, less costly to manufacture. Accordingly, this device 100 does not include the pairs of hooks. Further, this device 100 does not included the ability to alternate the curved central portions of the rails between the curved position and the release position. Therefore, the rails 106 do not include release buttons.

This device 100 has an additional feature that is not included in device 10. The device 100 includes a pair of grip bars 126 fixedly connected and in orthogonal relation to the frame 104. The grips bars 126 are disposed with one on the first end side of the frame 102 and the other on the second end side of the frame 102, with each being located intermediate to one of the cross connection bars 124 and an end member 114,116. In particular, each of the grip bars 126 is connected to the frame 102 such that it is aligned with the horizontal plane of a corresponding one of the handles 128.

Despite the removal of features as compared to device 10, this device 100 retains much of the functionality provided by device 10. As such, many of the exercises that can be performed using device 10 may also be performed using this device 100.

The exercise device 10,100 provides a more versatile exercise device that enables a person to have a complete workout experience with a single device, i.e., a single device that may be used for stretching, core strengthen training, balance training, cardiovascular exercise and strength training. A user may exercise with the device 10,100 at home for a complete workout experience at home or may exercise with the device 10,100 at a gym or workout facility. In addition, the device 10,100 is ideal for a group workout class wherein participants want a full range of exercise activities. The device 10,100 is compact and lightweight, so it is easy to use in small spaces and easy to transport.

Based on the foregoing description, it will be readily understood by those persons skilled in the art that the present invention is susceptible of broad utility and application. Many embodiments and adaptations of the present invention other than those specifically described herein, as well as many variations, modifications, and equivalent arrangements, will be apparent from or reasonably suggested by the present invention and the foregoing descriptions thereof, without departing from the substance or scope of the present invention. Accordingly, while the present invention has been described herein in detail in relation to one or more preferred embodiments, it is to be understood that this disclosure is only illustrative and exemplary of the present invention and is made merely for the purpose of providing a full and enabling disclosure of the invention. The foregoing disclosure is not intended to be construed to limit the present invention or otherwise exclude any such other embodiments, adaptations, variations, modifications or equivalent arrangements, the present invention being limited only by the claims appended hereto and the equivalents thereof.

What is claimed is:

1. An exercise device, comprising:

(a) a frame, including, (i) a pair of spaced apart arcuate rails, each arcuate rail having a central curved portion, a first end, and a second end, (ii) a first end member interconnecting the first ends of the arcuate rails of the frame, and (iii) a second end member interconnecting the second ends of the arcuate rails of the frame; and (b) a platform configured to receive and support a person on the exercise device, the platform extending between and connected to the first and second ends of the pair of arcuate rails;

(c) wherein, (i) the central curved portions of the pair of arcuate rails of the frame protract from a first support surface of the platform such that the central curved portions of the pair of arcuate rails of the frame are configured to support the platform on a floor in a configuration in which the exercise device is prone to end-to-end rocking motion of the exercise device relative to the floor between the first and second end members of the frame when a person is received and supported on the first support surface of the platform, (ii) the first and second end members of the frame protract from a second support surface of the platform such that the first and second end members of the frame are configured to support the platform on the floor in a configuration in which the exercise device is not prone to rocking motion relative to the floor when a person is received and supported on the second support surface of the platform, the first and second support surfaces being on opposite sides of the platform, and (iii) the first and second end members comprise a pair of hooks, each hook configured to releasably receive a resistance band.

2. The exercise device of claim 1,wherein the first and second end members comprise a pair of handles.

3. The exercise device of claim 1, wherein the first and second end members comprise two pairs of hooks, each hook configured to releasably receive a resistance band.

4. An exercise device, comprising:

(a) a frame, including, (i) a pair of spaced apart arcuate rails, each arcuate rail having a central curved portion, a first end, and a second end, (ii) a first end member interconnecting the first ends of the arcuate rails of the frame, and (iii) a second end member interconnecting the second ends of the arcuate rails of the frame; and (b) a platform configured to receive and support a person on the exercise device, the platform extending between and connected to the first and second ends of the pair of arcuate rails;

(c) wherein, (i) the central curved portions of the pair of arcuate rails of the frame protract from a first support surface of the platform such that the central curved portions of the pair of arcuate rails of the frame are configured to support the platform on a floor in a configuration in which the exercise device is prone to end-to-end rocking motion of the exercise device relative to the floor between the first and second end members of the frame when a person is received and supported on the first support surface of the platform, (ii) the first and second end members of the frame protract from a second support surface of the platform such that the first and second end members of the frame are configured to support the platform on the floor in a configuration in which the exercise device is not prone to rocking motion relative to the floor when a person is received and supported on the second support surface of the platform, the first and second support surfaces being on opposite sides of the platform, and (iii) the central curved portion of each respective arcuate rail is connected to the first and second ends of the respective arcuate rail such that the central curved portion is movable relative to the first and second end portions between, (A) a curved position, in which the central curved portions of the pair of arcuate rails of the frame protract from the first support surface of the platform such that the central curved portions of the pair of arcuate rails of the frame are configured to support the platform on a floor in a configuration in which the exercise device is prone to end-to-end rocking motion of the exercise device relative to the floor between the first and second end members of the frame when a person is received and supported on the first support surface of the platform, and (B) a release position, in which the central curved portions of the pair of arcuate rails of the frame protract from the second support surface of the platform such that the central curved portions of the pair of arcuate rails of the frame are not configured to support the platform on a floor.

5. The exercise device of claim 4, wherein the central curved portion of each respective arcuate rail is connected to the first and second ends of the respective arcuate rail such that the central curved portion is rotatable relative to the first and second end portions.

6. The exercise device of claim 4, wherein the platform extends between but is not directly connected to either of the arcuate rails of the frame.

7. The exercise device of claim 4, further comprising locking mechanisms configured to releasably lock the pair of arcuate rails in the curved position, and wherein each locking mechanism includes a button for releasing the arcuate rails for moving to the release position.

8. The exercise device of claim 1, wherein the central curved portions of the pair of arcuate rails of the frame protract from the first support surface of the platform such that the central curved portions of the pair of arcuate rails of the frame are configured to support the platform on a floor in a configuration in which the exercise device is prone to end-to-end rocking motion of the exercise device relative to the floor between the first and second end members of the frame, but is not prone to side-to-side rocking motion of the exercise device relative to the floor, when a person is received and supported on the first support surface of the platform.

9. The exercise device of claim 1, wherein each of the pair of spaced apart arcuate rails defines a side surface of the exercise device, each side surface being configured to support the exercise device on a floor in a configuration in which the exercise device is not prone to rocking motion relative to the floor and in which the platform extends generally orthogonally to a plane of the floor.

10. A method of exercising, comprising:

(a) providing an exercise device, comprising:

(i) a pair of spaced apart arcuate portions, (ii) a first end member interconnecting a first end of the pair of arcuate portions, (iii) a second end member interconnecting a second end of the pair of arcuate portions, (iv) a platform configured to receive and support a person on the exercise device, the pair of arcuate portions protracting from the platform such that the arcuate portions are configured to support the platform on a floor in a configuration in which the exercise device is prone to end-to-end rocking motion of the exercise device relative to the floor between the first and second end members, but is not prone to side-to-side rocking motion of the exercise device relative to the floor, and (v) a pair of resistance bands for exercising, each resistance band including an elongate body having a hand grip at a first end thereof and being connected at an opposite end thereof to a respective one of the first and second end members of the exercise device;

(b) placing the exercise device on a floor such that the pair of protracting arcuate portions support the platform on the floor in a configuration in which the exercise device is prone to end-to-end rocking motion of the exercise device relative to the floor between the first and second end members, but is not prone to side-to-side rocking motion of the exercise device relative to the floor;

(c) balancing one's self on the platform while the exercise device is prone to end-to-end rocking motion of the exercise device relative to the floor between the first and second end members, but is not prone to side-to-side rocking motion of the exercise device relative to the floor;

(d) and while balancing one's self on the platform, exercising with the resistance bands;

(e) turning the exercise device upside down on the floor such that the first and second end members support the exercise device on the floor in a stationary position wherein the exercise device is not prone to rocking motion;

(f) balancing one's self on the platform while the exercise device is in the stationary position; and (g) while balancing one's self on the platform, exercising with the resistance bands.

11. A method of exercising, comprising:

(a) providing an exercise device, comprising:

(i) a pair of spaced apart arcuate portions, (ii) a first end portion interconnecting a first end of the pair of arcuate portions, (iii) a second end portion interconnecting a second end of the pair of arcuate portions, (iv) a platform configured to receive and support a person on the exercise device, the pair of arcuate portions protracting from the platform such that the arcuate portions are configured to support the platform on a floor in a configuration in which the exercise device is prone to end-to-end rocking motion of the exercise device relative to the floor between the first and second end portions, but is not prone to side-to-side rocking motion of the exercise device relative to the floor, and (v) a pair of resistance bands for exercising, each resistance band including an elongate body having a hand grip at a first end thereof and being connected at an opposite end thereof to the exercise device and extending from a respective one of the first and second end portions of the exercise device;

(b) placing the exercise device on a floor such that the pair of protracting arcuate portions support the platform on the floor in a configuration in which the exercise device is prone to end-to-end rocking motion of the exercise device relative to the floor between the first and second end portions, but is not prone to side-to-side rocking motion of the exercise device relative to the floor;

(c) balancing one's self on the platform while the exercise device is prone to end-to-end rocking motion of the exercise device relative to the floor between the first and second end portions, but is not prone to side-to-side rocking motion of the exercise device relative to the floor;

(d) and while balancing one's self on the platform, exercising with the resistance bands;

(e) wherein said step of balancing one's self includes stepping onto the platform.

12. The method of claim 10, wherein said step of balancing one's self includes stepping onto the platform.

13. A method of exercising, comprising:

(a) providing an exercise device, comprising:

(i) a pair of spaced apart arcuate portions, (ii) a first end portion interconnecting a first end of the pair of arcuate portions, (iii) a second end portion interconnecting a second end of the pair of arcuate portions, (iv) a platform configured to receive and support a person on the exercise device, the pair of arcuate portions protracting from the platform such that the arcuate portions are configured to support the platform on a floor in a configuration in which the exercise device is prone to end-to-end rocking motion of the exercise device relative to the floor between the first and second end portions, but is not prone to side-to-side rocking motion of the exercise device relative to the floor, and (v) a pair of resistance bands for exercising, each resistance band including an elongate body having a hand grip at a first end thereof and being connected at an opposite end thereof to the exercise device and extending from a respective one of the first and second end portions of the exercise device;

(b) placing the exercise device on a floor such that the pair of protracting arcuate portions support the platform on the floor in a configuration in which the exercise device is prone to end-to-end rocking motion of the exercise device relative to the floor between the first and second end portions, but is not prone to side-to-side rocking motion of the exercise device relative to the floor;

(c) balancing one's self on the platform while the exercise device is prone to end-to-end rocking motion of the exercise device relative to the floor between the first and second end portions, but is not prone to side-to-side rocking motion of the exercise device relative to the floor;

(d) and while balancing one's self on the platform, exercising with the resistance bands;

(e) wherein said step of balancing one's self includes sitting on the platform.

14. The method of claim 10, wherein said step of balancing one's self includes sitting on the platform.

* * * * *